US006997995B2

(12) United States Patent
Janschek et al.

(10) Patent No.: US 6,997,995 B2
(45) Date of Patent: Feb. 14, 2006

(54) METHOD FOR PRODUCING COMPONENTS WITH A HIGH LOAD CAPACITY FROM TIAL ALLOYS

(75) Inventors: Peter Janschek, Düsseldorf (DE); Lothar Knippschild, Essen (DE); Karl Schreiber, Mellensee (DE); Dan Roth-Fagaraseanu, Berlin (DE)

(73) Assignees: Leistrits Turbinenkomponenten Remscheid GmbH, Remscheid (DE); Rolls-Royce Deutschland LTD & Co KG, Dahlewitz (DE)

( * ) Notice: Subject to any disclaimer, the term of this patent is extended or adjusted under 35 U.S.C. 154(b) by 140 days.

(21) Appl. No.: 10/415,316

(22) PCT Filed: Nov. 16, 2001

(86) PCT No.: PCT/EP01/13290

§ 371 (c)(1),
(2), (4) Date: Apr. 25, 2003

(87) PCT Pub. No.: WO02/48420

PCT Pub. Date: Jun. 20, 2002

(65) Prior Publication Data

US 2004/0094248 A1 May 20, 2004

(30) Foreign Application Priority Data

| | | |
|---|---|---|
| Dec. 15, 2000 | (DE) | 100 62 776 |
| Jan. 19, 2001 | (DE) | 101 02 497 |
| Feb. 2, 2001 | (DE) | 101 04 639 |
| Oct. 17, 2001 | (DE) | 101 50 674 |

(51) Int. Cl.
*C22C 14/00* (2006.01)
*C22F 1/18* (2006.01)

(52) U.S. Cl. ..... 148/669; 148/670; 148/671; 148/421; 420/418; 420/420

(58) Field of Classification Search ..... 148/669–671, 148/538, 421; 29/888.4; 419/3; 75/175.5; 420/418, 420

See application file for complete search history.

(56) References Cited

U.S. PATENT DOCUMENTS

| | | | | |
|---|---|---|---|---|
| 4,294,615 | A * | 10/1981 | Blackburn et al. | 420/420 |
| 5,489,411 | A * | 2/1996 | Jha et al. | 419/3 |
| 6,161,285 | A * | 12/2000 | Eberhardt et al. | 29/888.45 |
| 6,174,387 | B1 * | 1/2001 | Bellows et al. | 148/421 |
| H1988 | H * | 9/2001 | Kim et al. | 148/671 |
| 2004/0045644 | A1 * | 3/2004 | Guther et al. | 148/538 |

FOREIGN PATENT DOCUMENTS

WO WO02/101110 A2 * 12/2002

* cited by examiner

*Primary Examiner*—Roy King
*Assistant Examiner*—Lois Zheng
(74) *Attorney, Agent, or Firm*—Max Fogiel

(57) ABSTRACT

The invention relates to a method for producing components with a high load capacity from α+γ TiAl alloys, especially for producing components for aircraft engines or stationary gas turbines. According to this method, enclosed TiAl blanks of globular structure are preformed by isothermal primary forming in the α+γ– or α phase area. The preforms are then shaped out into components with a predeterminable contour by means of at least one isothermal secondary forming process, with dynamic recrystallization in the α+γ– or α phase area. The microstructure is adjusted by solution annealing the components in the α phase area and then cooling them off rapidly.

8 Claims, No Drawings

METHOD FOR PRODUCING COMPONENTS WITH A HIGH LOAD CAPACITY FROM TIAL ALLOYS

BACKGROUND OF THE INVENTION

The invention relates to a method for producing heavy-duty components from α+γ TiAl alloys, especially components for aircraft engines or stationary gas turbines.

TiAl-based alloys belong to the group of intermetallic materials, which were developed for uses at temperatures at which super alloys are used. With a density of about 4 g/cc, this new class of alloys offers a considerable potential for weight reduction and, in association therewith, a reduction in stresses of moving components at temperatures up to above 700° C. This weight and stress reduction acts exponentially also on the buckets and blades of gas turbines or, for example, of components of piston engines. The difficulty of processing TiAl alloys by shaping processes is based on the high yield points as well as the low fracture toughness and ductility at low and moderate temperatures. Shaping processes must therefore be carried out at high temperatures in the region of the α+γ or α phase areas under an inert atmosphere.

U.S. Pat. No. 6,110,302 discloses α+γ titanium alloys. Among other things, turbine blades for aircraft engines are dealt with. The use of alloys with about 70% titanium is preferred, the forging temperature being between 815° C. and 885° C. The forging, forming such products as turbine blades, is to have β+α−β regions of different microstructure. Practical investigations have shown that turbine blades, produced according to this method, do not satisfy the requirements in the operating state, especially with regard to the desired fatigue strength.

U.S. Pat. No. 5,593,282 discloses a rotor, which can be used in engines and may be formed, preferably, from a lightweight construction material, in this example from a temperature-resistant ceramic material or, alternatively, from TiAl or NiAl materials.

In the DE-C 43 18 424, a method is described for producing molded objects from alloys based on titanium and aluminum. A cast preform with a lamellar structure with a thickness of up to 1 μm is produced. This is shaped at a temperature ranging from 1050° C. to 1300° C. with a high degree of deformability, so that a dynamic recrystallization with particle sizes up to 5/μm takes place. Subsequently, the preform is cooled and shaped superplastically at temperatures ranging from 900° C. to 1100° C. at rates of $10^{-4}$/s to $10^{-3}$/s to molded objects having almost the final dimensions. The very fine-grained structure addressed is produced, for example, by the addition of up to 0.3% by weight of silicon. However, this proportion of silicon leads to undesirable side effects, such as an increased porosity and the formation of silicides, as a result of which the mechanical stressability is affected greatly. The fine-grained structure, required for this superplastic shaping is to be brought about by extrusion molding, which does not, however, lead to the finely crystalline, equiaxial structure, which is described elsewhere and required for the superplastic shaping. The extent, to which components, which can be stressed highly mechanically, can actually be produced by this method, is unknown, since this method has not yet gained acceptance in practice.

On the basis of the shaping factors, shown here, the manufacturing methods, addressed in the state of the art and intended, for instance, for TiAl components, do not lead to the technical quality properties required for components, which can be highly stressed dynamically and thermally.

SUMMARY OF THE INVENTION

Starting out from the disadvantages listed in the state of the art, it is an object of the invention to make available a method for the production of light-weight, heavy duty components for the conventional technology and air traffic technology from TiAl alloys with which, in comparison to state of the art, improved fatigue strength, reliability and an increased service life can be realized.

This objective is accompanied by a method for the production of heavy duty components from α+γ TiAl alloys, especially of components for aircraft engines or stationary gas turbines, in that encapsulated TiAl preforms of globular structure are pre-shaped by isothermal primary shaping in the α+γ or α phase area, the pre-shaped preforms are shaped by at least one isothermal secondary process with dynamic recrystallization in the α+γ or α phase area to components of a specifiable contour and, for setting the micro structure, the components are solution annealed in the α phase area and subsequently cooled rapidly.

Advantageous further developments of the inventive method may be inferred from the dependent claims.

DESCRIPTION OF THE PREFERRED EMBODIMENTS

Deviating from the state of the art of U.S. Pat. No. 6,110,302 and DE-C 43 18 424, TiAl preforms are now shaped repeatedly at temperature ranges above the temperatures given there and achieve structure properties, which are associated with a longer service life than that of the state of the art. Moreover, the use properties, especially the fatigue strength, can be improved significantly.

Very homogeneous, TiAl preforms are used with a globular grain structure, which is subjected in an appropriate manner to a primary shaping, which is followed by a secondary shaping, in the α+γ or α phase area.

The primary shaping can be accomplished by forging or extrusion molding. The secondary shaping advantage is accomplished by forging.

During the primary shaping, as well as during the secondary shaping, the forging preforms are encapsulated, for example, by a shape-producing tool with an upper and a lower part, as is understood by those skilled in the art.

Contrary to the state of the art of DE-C 43 18 424 (process window of superplasticity), the suitable forging windows are characterized by a pronounced flow-stress maximum. The dynamic recrystallization, which is associated with a high yield point, is characteristic of the inventive shaping process. The microstructure is made available by solution annealing of the components in the α phase area and subsequently, cooling them rapidly. This rapid cooling from the α phase area then leads to the desired fine lamellar microstructure. Typical cooling rates for this purpose are of the order of 10° C./s.

Advantageously, for producing the lightweight, heavy duty components for conventional technology and air traffic technology, preforms of the following composition (in atom percent) are used:

43%–47%, especially 45%–47% Al
5%–10% Nb
maximum 8.0% B
maximum 0.5% C
Remainder: titanium and impurities resulting from the smelting.

Silicon is not contained in these alloys. Although, on the one hand, as is well known, it contributes-to--the desired grain refining, it also, on the other, leads to the already addressed, undesirable side effects, such as porosity and silicide formation.

The isothermal shaping (primary and/or secondary) advantageously takes place in heated tools of molybdenum or graphite.

The following example describes a method for producing rotor disks, which may be used in aircraft gas turbines. The example may also refer to heavy-duty components, other than those for conventional technology or air traffic technology, such as components of internal combustion engines, such as valves.

A preform of the following chemical composition (in atom percent) is used:

46% Al
7.5% Nb
0.3% C
0.5% B
remainder: Ti

In a first step, the preform is subjected to an isothermal primary shaping at an $\alpha+\gamma$ temperature of 1200° C. A flat track-forging die is used, with which so-called pancakes are produced. The isothermal primary shaping takes place at a rate of $10^{-4}$/s. In a second, isothermal forging process, the pancakes are forged into finished disks with a shape-producing forging tool with an upper part and a lower part. In this example, the isothermal secondary shaping takes place at an $\alpha+\gamma$ temperature of 1150° C. and a shaping rate of $10^{-3}$/s.

For adjusting the later use properties of the rotor disks, so produced, the latter are solution annealed at a temperature of 1360° C. and subsequently cooled rapidly in oil at a rate of 10° C./s. The finishing is conventional and not an object of this invention.

The following example shows a method of producing turbine buckets, which can be used in stationary gas turbines.

A preform of the following composition (in atom percent) is used:

45% Al
8% Nb
0.2% C
Remainder Ti

The first forging process of a basic material for $\alpha+\gamma$ TiAl preforms takes place in this example owing to the fact that the volume distribution for a larger number of preforms (10 here) is carried out in the $\alpha+\gamma$ phase area at about 1150° C. in a forging die with a disk-shaped recess. In this example, the preforms are segregated at a high temperature by a cutting tool. As a result, cooling of the preforms with subsequent re-heating for further shaping processes becomes unnecessary.

In a second isothermal forging process, the forging of the preform to buckets is completed in a shaping forging tool with an upper part and a lower part. The secondary shaping takes place in this example in the $\alpha+\gamma$ phase area at about 1150° C. and at a shaping rate of $10^{-3}$/s.

To set the later use properties of the turbine buckets so produced, the latter are solution annealed at an $\alpha$ temperature of 1360° C. and subsequently cooled rapidly in oil.

The production processes of further components differ from this example only in their geometric formation.

The composition of the alloys, described above, as well as the temperature ranges selected for the primary and secondary isothermal shaping merely represents examples.

What is claimed is:

1. A method for producing heavy-duty components from $\alpha+\gamma$ TiAl alloys for aircraft engines or stationary gas turbines, in that preshaping encapsulated TiAl preforms of globular structure by isothermal primary shaping in the $\alpha+\gamma$ or $\alpha$ phase area in a temperature region of 1000° C. to 1,340° C. by forging or extrusion molding; shaping the preforms by forging to form components with a specifiable contour by at least one isothermal secondary shaping process simultaneously with dynamic recrystallization in the $\alpha+\gamma$ or $\alpha$ phase area in the temperature region of 1000° C. to 1,340° C. in an inert atmosphere, said preshaping and shaping steps be carried out in a heated tool of molybdenum or graphite; adjusting the microstructure of the components by solution annealing in the $\alpha$ phase area and cooling subsequently rapidly.

2. The method as defined in claim 1, wherein the isothermal primary shaping is carried out by forging or extrusion molding in the $\alpha+\gamma$ phase area at temperatures ranging from 1000° C. to 1,340° C.

3. The method as defined in claim 1, wherein the isothermal primary shaping is carried out by forging or extrusion molding in the $\alpha$ phase area at temperatures between 1340° C. and 1,360° C.

4. The method as defined in claim 1, wherein the isothermal secondary shaping is carried out in the $\alpha+\gamma$ phase area at temperatures ranging from 1000° C. to 1,340° C.

5. The method as defined in claim 1, wherein the secondary shaping process and the solution annealing process are carried out in an inert atmosphere.

6. The method as defined in claim 1, wherein the cooling to a final adjustment of structure from the $\alpha$ phase area above 1340° C. takes place very rapidly, especially at a rate of 10° C./s to 20° C./s in oil.

7. A method for producing heavy-duty components from $\alpha+\gamma$ TiAl alloys for aircraft engines or stationary gas turbines, in that preshaping encapsulated TiAl preforms of globular structure by isothermal primary shaping in the $\alpha+\gamma$ or $\alpha$ phase area in a temperature region of 1000° C. to 1,340° C. by forging or extrusion molding; shaping the preforms by forging to form components with a specifiable contour by at least one isothermal secondary shaping process simultaneously with dynamic recrystallization in the $\alpha+\gamma$ or $\alpha$ phase area in the temperature region of 1000° C. to 1,340° C. in an inert atmosphere, said preshaping and shaping steps be carried out in a heated tool of molybdenum or graphite; adjusting the microstructure of the components by solution annealing in the $\alpha$ phase area and cooling subsequently rapidly, the isothermal primary shaping being carried out by forging or extrusion molding in the $\alpha+\gamma$ phase area at temperatures ranging from 1000° C. to 1,340° C., the isothermal primary shaping being carried out by forging or extrusion molding in the $\alpha$ phase area at temperatures between 1340° C. and 1,360° C., said preforms of a TiAl base alloy of the following composition (in atom percent) are used for the primary and second shaping:

43%–47% Al
5%–10% Nb
maximum 1.0% B
Maximum 0.5% C,
said cooling to a final adjustment of structure from the $\alpha$ phase area above 1340° C. taking place very rapidly, especially at a rate of 10° C./s to 20° C./s in oil.

8. The method as defined in claim 7, wherein preforms of a TiAl base alloy of the following composition (in atom percent) are used for the primary and secondary shaping:

43%–47% Al
5%–10% Nb
maximum 1.0% B
Maximum 0.5% C
Remainder titanium and impurities resulting from the smelting.

* * * * *